US005411046A

United States Patent [19]

Wan

[11] Patent Number: 5,411,046

[45] Date of Patent: May 2, 1995

[54] TENT

[75] Inventor: Tak M. Wan, Kowloon, Hong Kong

[73] Assignee: Arrow Link Industries Limited, Kowloon, Hong Kong

[21] Appl. No.: 17,070

[22] Filed: Feb. 2, 1993

[30] Foreign Application Priority Data

Feb. 3, 1992 [GB] United Kingdom ..... 9202243

[51] Int. Cl.[6] ..... E04H 15/40

[52] U.S. Cl. ..... 135/126; 135/128

[58] Field of Search ..... 135/104, 106, 109, 112

[56] References Cited

U.S. PATENT DOCUMENTS 5,038,812 8/1991 Norman ..... 135/104

5,137,044 8/1992 Brady ..... 135/104

*Primary Examiner*—Carl D. Friedman

*Assistant Examiner*—Creighton Smith

*Attorney, Agent, or Firm*—Pennie & Edmonds

[57] ABSTRACT

A collapsible tent has four triangular walls 30 each consisting of foldable material having a respective peripheral triangular shaped channel 31 which constrains a coilable wire frame. To collapse the tent the walls are folded together into a triangular shaped stack and then the wire frames are twisted and folded into overlapping loops.

14 Claims, 7 Drawing Sheets

TENT

FIELD OF THE INVENTION

The invention relates to tents.

The invention relates more particularly to collapsible tents.

BACKGROUND OF THE INVENTION

A collapsible tent has already been proposed in U.S. Pat. No. 482,892, see in particular in FIG. 18, in which a continuous figure-8 frame member is provided having an upper crossover and carries panels of cloth material. The tent in FIG. 18 can be collapsed and folded up by coiling up the frame as fully explained in the specification. Separate coilable frames have also been proposed in which support fabric panels are coupled together to provide a tent as described in PCT application PCT/US90/04574. The panels are joined together by connections at the "cop right hand part" of one panel and the "top left hand part" of an adjacent panel (where 120 is the top left hand part and 122 is the top right hand part of respective panels, see for example page 12 lines 13 to 16).

SUMMARY OF THE INVENTION

It has also been proposed to provide a foldable car sun shade in U.S. Pat. No. 4,815,748, in which two panels are joined end to end to spread out across a car window in an expanded configuration. The panels overlap and coil up together as required for storage.

It is the object of the present invention to provide a foldable tent which is more readily erectable and is simpler to manufacture than earlier proposed arrangements.

According to the invention there is provided a foldable tent which can be transformed from a fully collapsed configuration to a self supporting expanded configuration and vice versa, the tent comprising three or more joined together wall members, each wall member having a flexible frame formed of a single loop of coilable material when expanded and overlapping loops when collapsed and a wall panel of foldable material having a peripheral channel for constraining the frame into a generally triangular or rectangular shape with two sides and a base for each wall member when the wall panel is expanded, in which the sides of each wall member are securely and hingably joined to the sides of adjacent wall members so that the adjacent sides are held at least generally parallel to one another when the tent is in its expanded configuration.

The adjacent sides may each be joined together and separated from one another by a respective elongate strip of foldable material extending along and between the sides of the wall members.

A tent floor formed of foldable material may extend between and join together the bases of the wall members. A foldable roof panel which extends between and connects the apexes of the triangles or tops of the rectangles together may be provided.

The tent may have removable brace members which extend and hold opposing apexes of the triangles or tops of the rectangles apart from one another when the tent is in its expanded configuration.

Ground ties may be fixed to the tent generally in alignment with central axes parallel to each pair of adjacent sides of the wall members.

Preferably, each wall member is a well-rounded triangular or rectangular shape when expanded.

One or more of the panels may be provided with a closable opening to form a respective door of the tent. At least one of the panels may be partly or wholly formed of transparent or translucent material. A ventilator may be provided in one or more of the panels. The ventilator may comprise a gauze or the like section covered by a loose flap to prevent rain entering the tent through the gauze section.

BRIEF DESCRIPTION OF THE DRAWINGS

A tent according to the invention will now be described by way of example with reference to the accompanying drawings in which:

Referring to the drawings, in FIG. 1A a generally triangular shaped tent frame is shown formed of resilient coilable wire. Normally, the wire frame would form naturally into a circle but is shown here as when constrained for use with the described tent. To form the frame into a multi-coiled configuration, the sequence shown, 1A to 1F is followed. Thus, FIG. 1A represents a fully expanded configuration for a tent panel and FIG. 1F represents a fully collapsed configuration.

DETAILED DESCRIPTION OF THE INVENTION

Figure 1B:
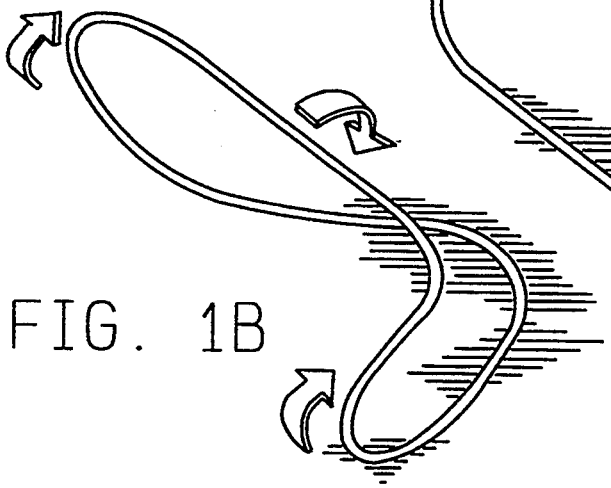
FIGS. 1A to 1F show an exposed single closed loop of wire and the manner of folding it into three superimposed coils.
Figure 1A:
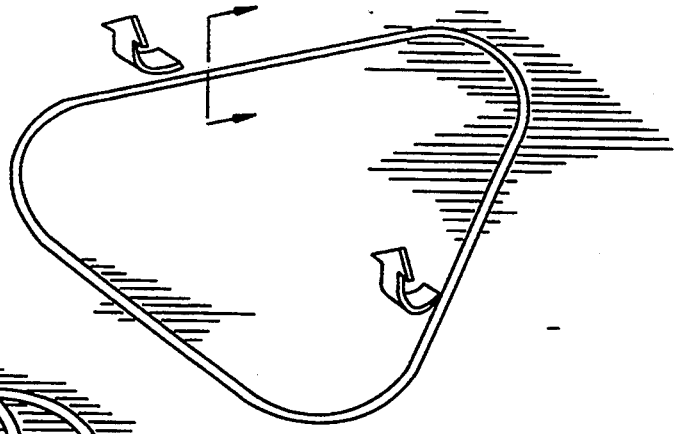
Figure 1C:
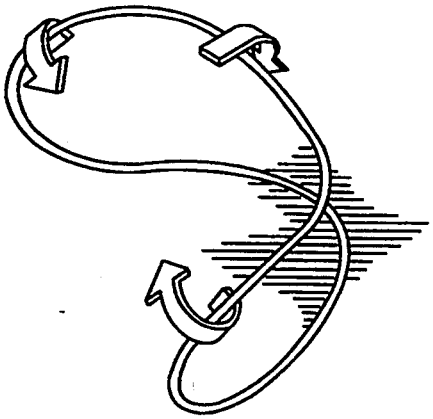
Figure 1D:
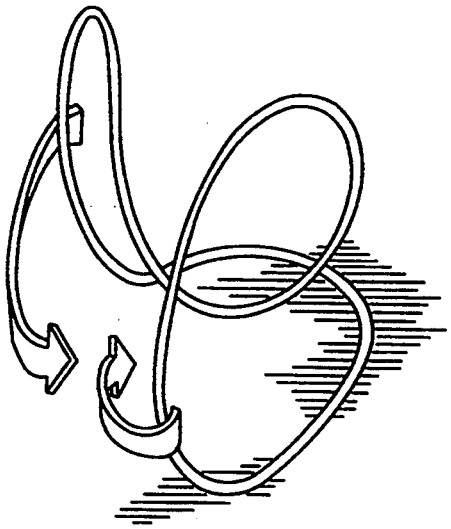
Figure 1E:
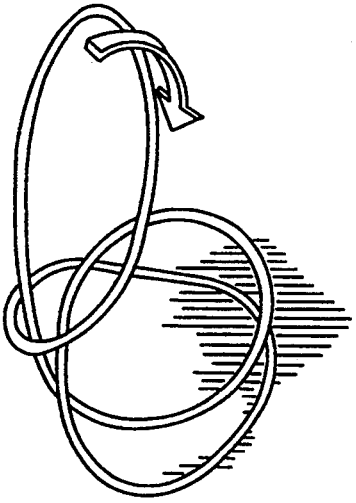
Figure 1F:
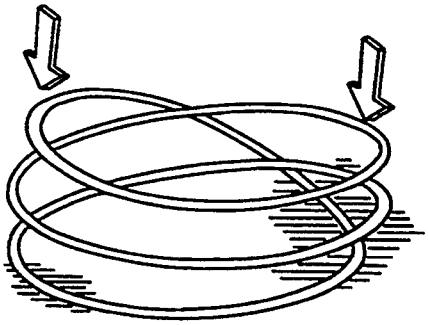
Figure 2A:
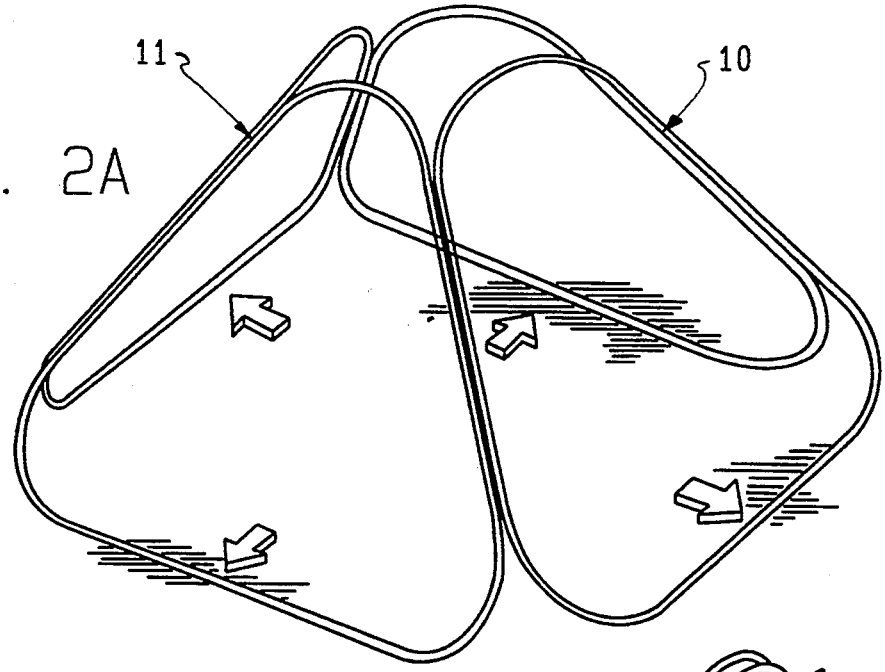
FIGS. 2A to 2D show four closed loops, their formation into a tent frame and different possible configurations thereof.
Figure 2B:
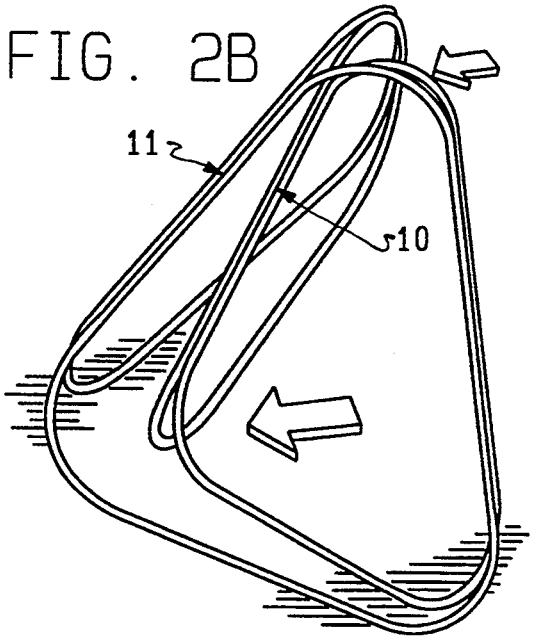
Figure 2C:
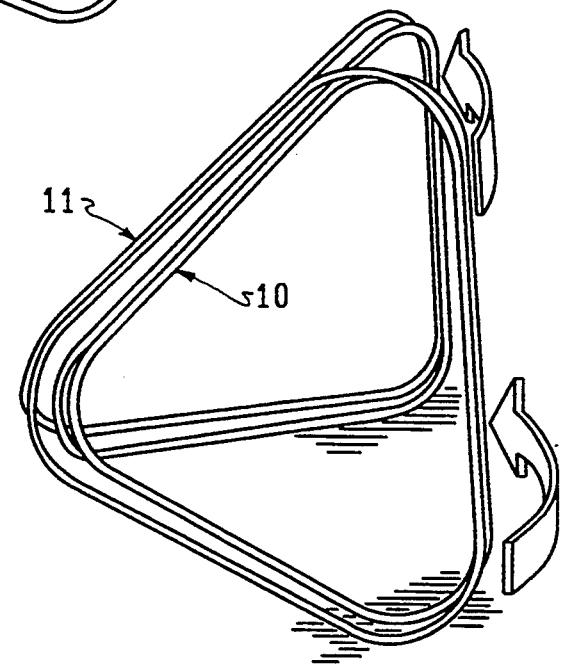
Figure 2D:
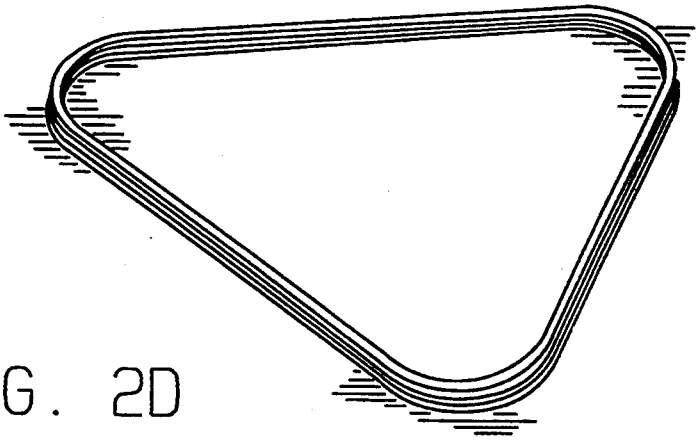

In the described tent four frames formed of resilient coilable wire are used and during the collapse of the tent, the four frames are manually manipulated from the configuration shown in FIG. 2A to the configuration shown in 2D. In order to collapse the tent, the steps or sequence shown in FIGS. 2B to 2D is followed. It will be noted that the frames fold neatly together over one another and that one corner, say, 10, must fold inside an opposite corner 11. Corners 12 and 13 are then brought together to allow the panels to line up with one another as in FIG. 2D. It will be noted that the frames are connected together and that at least the corner 11 is "loosely" hinged so as to allow the joined frames forming the tent corner 10 to slide inside and between the frames forming the corner 11.

Figure 3A:
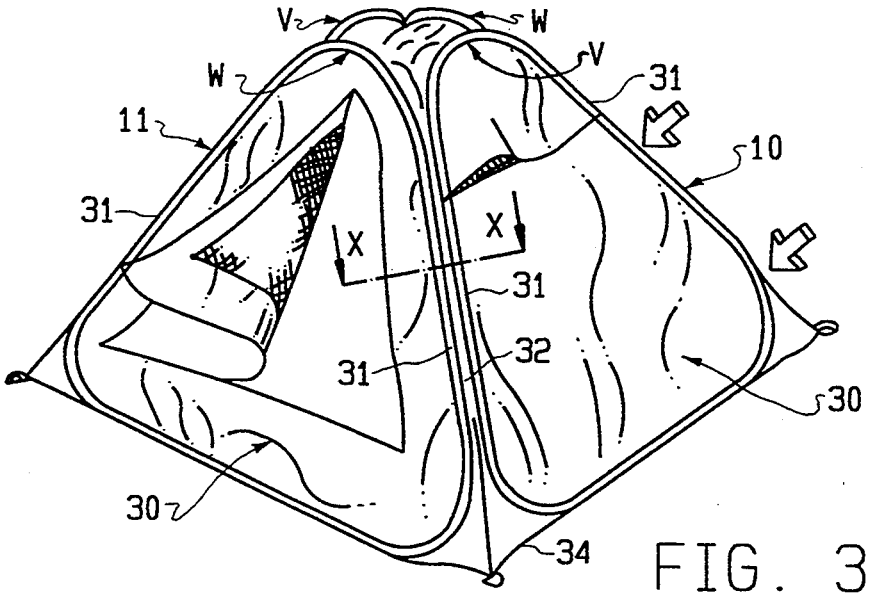
FIGS. 3A to 3K show the tent and steps of how it is collapsed in practice.

FIG. 3A shows the tent in the fully expanded configuration. The tent comprises four similar generally triangular walls 30. Each wall panel consists of foldable material having a peripheral channel 31 in which a coilable wire is constrained and provides the supporting tent frame for its respective wall. Each frame has two sides and a base, which base rests against the ground in use. An elongate strip of foldable material 32 extends along the sides and between each adjacent pair of frames and provides a loose hinged connection between respective adjacent sides of the panels. The strip extends to form a roof 33 for the tent and can also extend, or be joined, to a floor 34 for the tent. The floor 34 extends between and connects together the bases of the walls.

When the tent is fully erected, that is, in its fully expanded configuration, two braces are fitted to urge the apexes apart and elongate pockets (not shown) are provided in the roof material. Rods are fitted in the pockets to hold the apexes V—V and W—W apart. These braces serve to spread out the material of strips 32 towards the upper ends of the sides of the panels and generally keep the roof material taut. This means that despite the "loose" connections between the frames provided by the foldable strips 32, the walls of the tent remain stably connected especially once the braces are fitted.

The fully erected tent is remarkably stable in use. The floor 34, which prevents the bases of the frames splaying out, offers a sound relatively broad base for the tent. The hinged pairs of parallel side members are inherently evenly distributed, i.e. in embodiments of the invention they are mutually supportive of one another in holding up the tent.

Figure 3B:
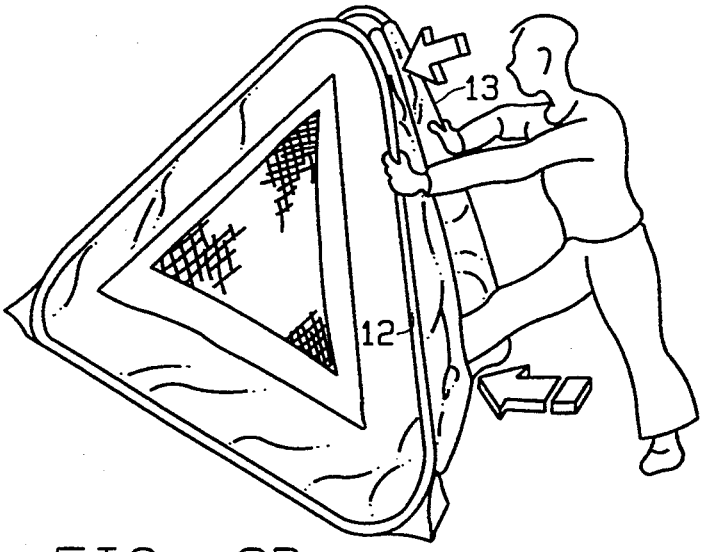
Figure 3C:
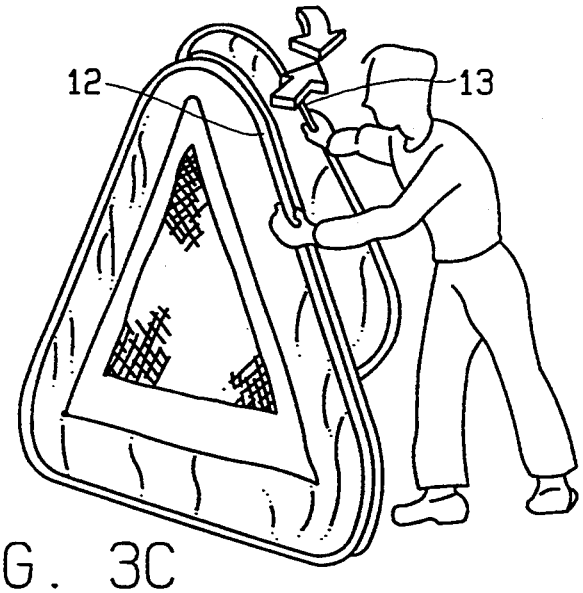
Figure 3D:
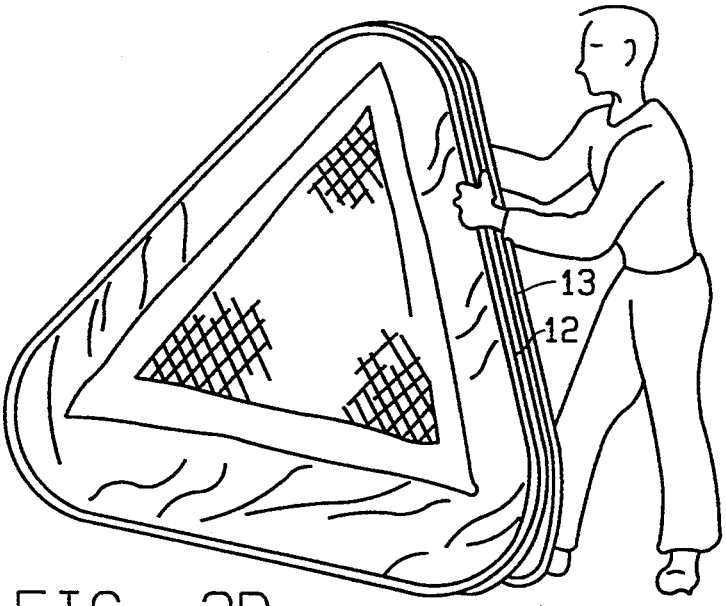
Figure 3E:
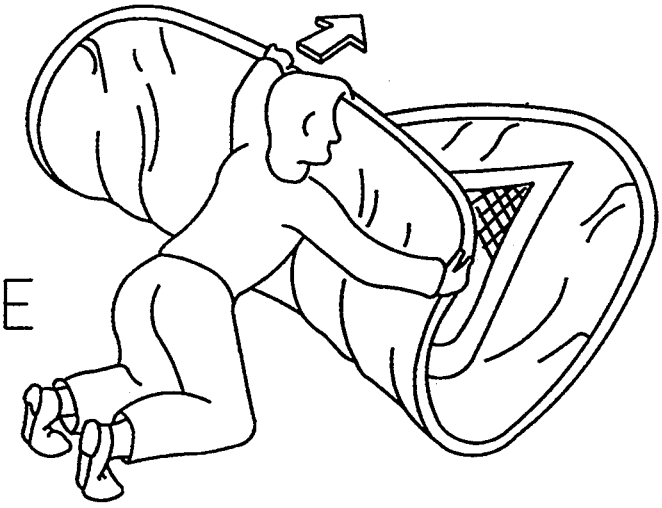
Figure 3F:
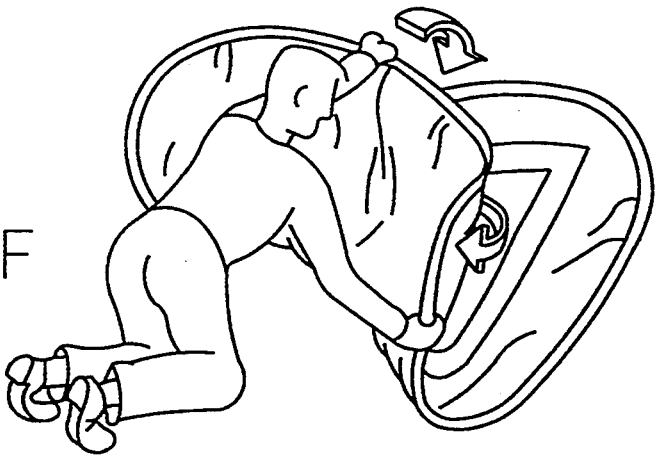
Figure 3G:
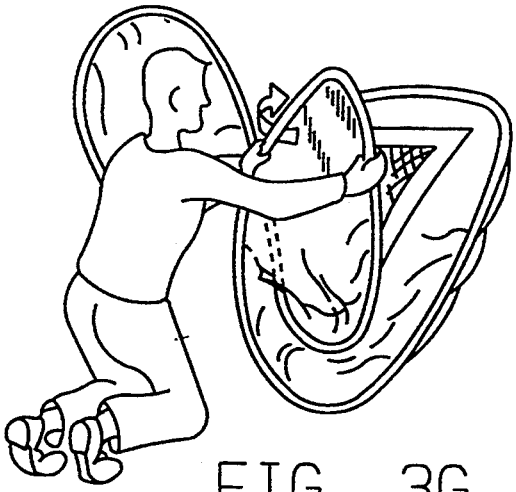
Figure 3H:
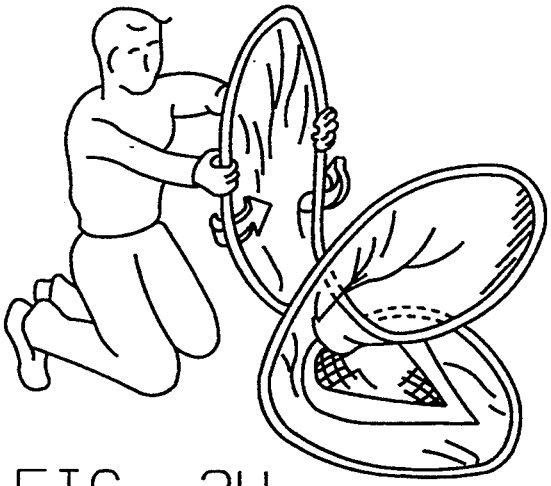
Figure 3I:
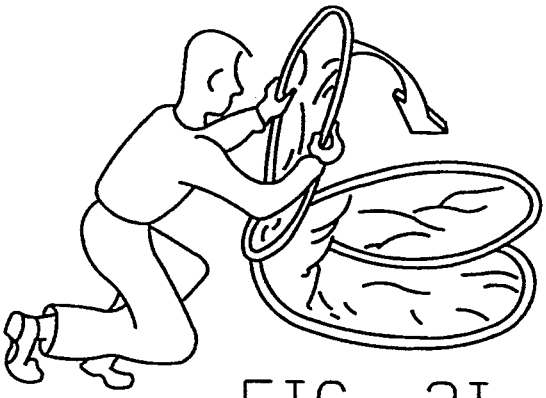
Figure 3J:
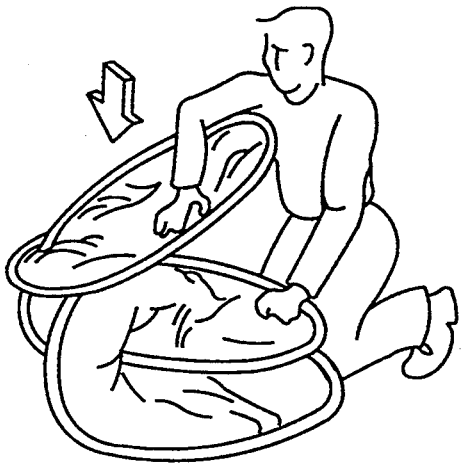
Figure 3K:
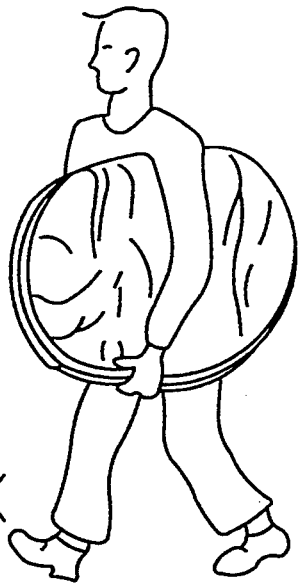

It will be seen by following the sequence or steps shown in FIGS. 3A to 3K, how the tent is changed from its fully expanded configuration (FIG. 3A) to its fully collapsed configuration (FIG. 3K). In FIGS. 3D to 3K, only wall one panel is actually shown, for ease of illustration, although in fact the four frames of the panels are folded up together, that is coiled up together, in practice.

In FIG. 3B, when collapsing the tent, the central two frames are pushed between the outer two frames generally in the direction of the arrows. However, for ease of locating together the lower corners farthest from the user, the inner frames are lifted somewhat up from the ground so as to be then pushed downwards and inwards towards the opposite bottom corners of the outer frames. In similar fashion, when the tent is being erected, the user reaches in between the folded together outer frames to lift the farthest corner of the inner frames generally upwards and towards himself to open the tent into its fully expanded configuration. In this manner, a user can readily expand and fold up the tent single-handed.

In use, the frames are securely and hingably joined together and where an even number of frames are used as preferred, usually four or six frames, no provision is made for allowing the frames to separate. If an uneven number of frames are used, say three or five frames, at least one of the hinged connections can be disconnected to allow one pair of adjacent sides to separate for collapsing the tent. For this purpose one of the strips 32 is provided with a zip fastener or the like joining the strip along a central line or joining one side of the strip to a respective side of a frame.

Figure 4:
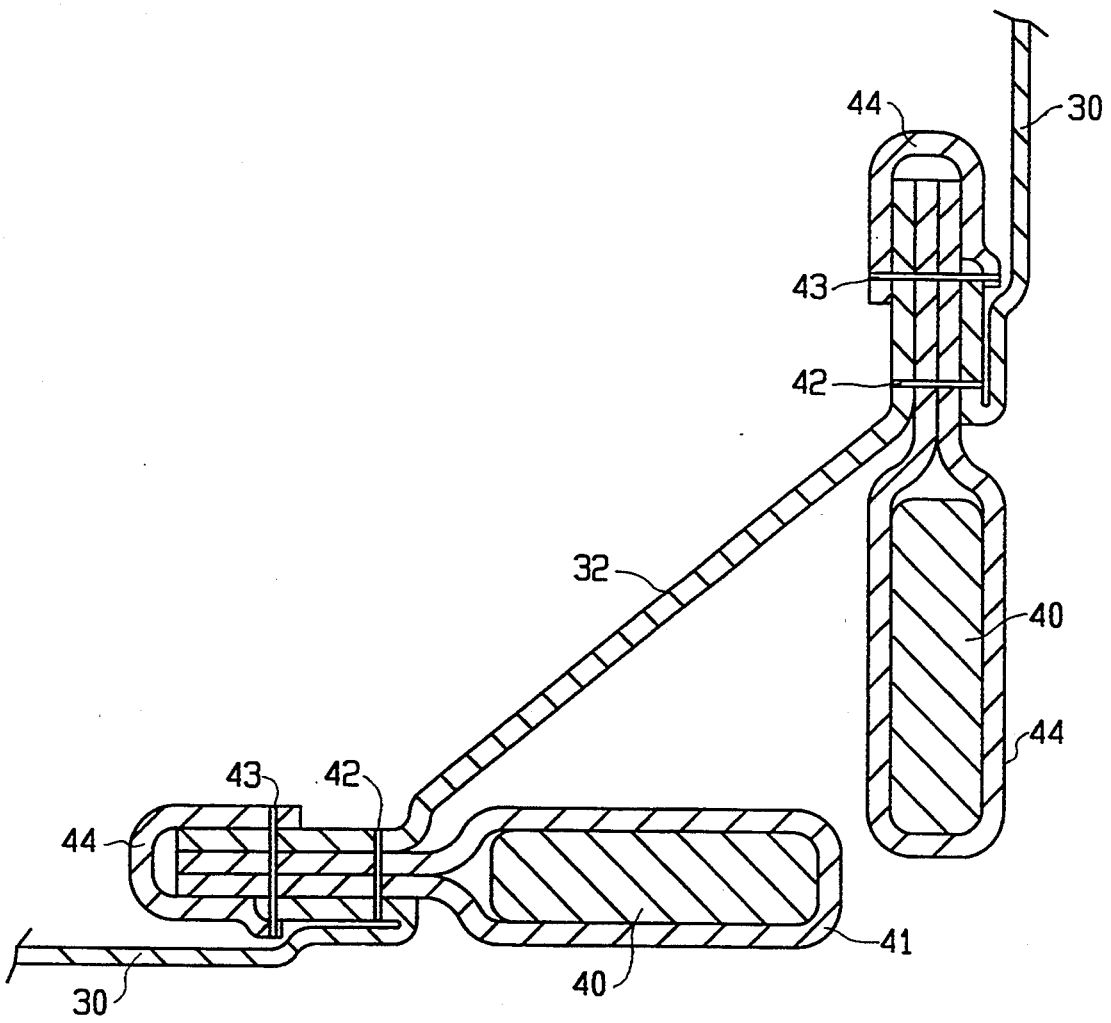
FIG. 4 shows a cross-section through X—X of FIG. 3A showing the practical connection between adjacent panels of the tent.

In FIG. 4, it can be seen that the "coilable wire" 40 is rectangular in cross-section. Each frame formed by the wire 40 is housed in a pocket or channel provided by an enclosure formed of braided material 41. The material 41 is joined and held together by stitching at 42 and 43. The stitching also holds the side panels or walls 30 and the edges of the strip 32 inside a protective cover of braided material 44. It will be appreciated that the strip 32 holds the sides of the panels 30 (or the frames 40) parallel to one another allowing them to hinge as and when required during collapsing and erecting of the tent.

Figure 5:
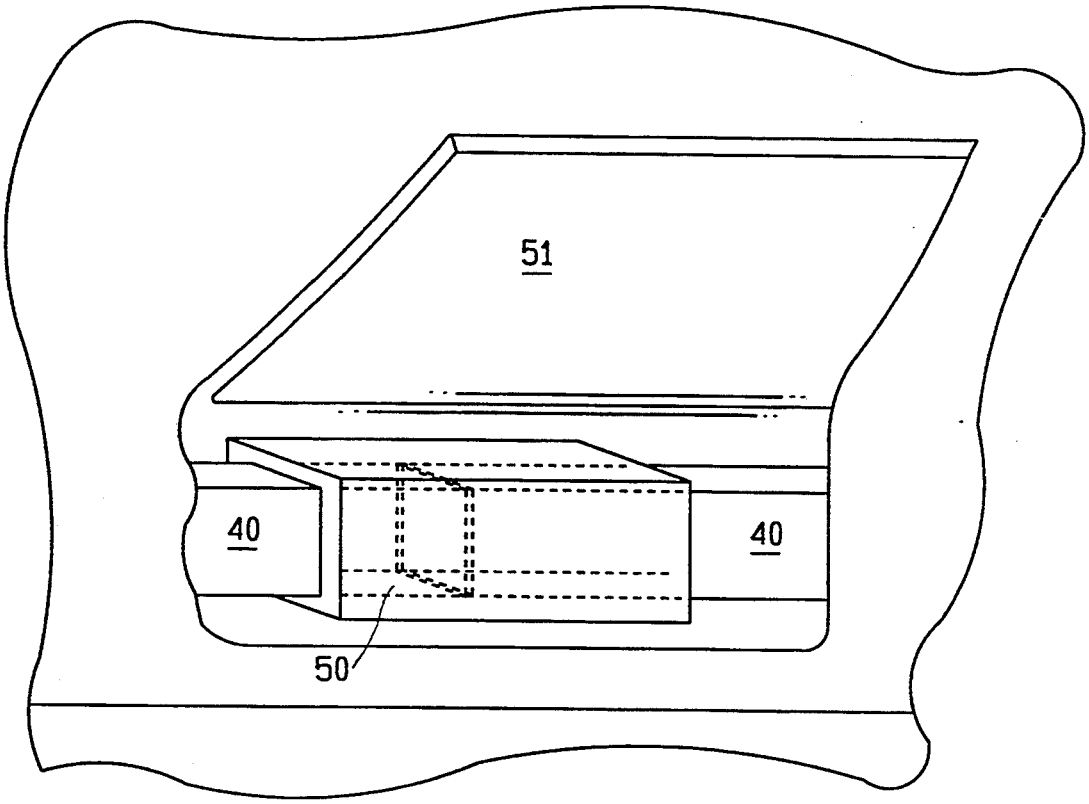
FIG. 5 shows part of one of the bases of the panels with a section of its frame exposed.

In FIG. 5 a central lower region of the base of a wall panel is shown. The frame member 40 here consists of a loop of rectangular shaped wire joined by a collar 50 which fits over and holds the ends of the loop together. Normally, the collar fits snugly to the ends of the frame members and will not slide along the frame members in normal use and so allow the ends of the frame members to become disconnected. The collar however may be riveted or otherwise secured to the ends of the frame members if desired.

A loose material flap 51, shown open in the Figure, fits over the joint and the collar 50 in normal use. The flap is opened when the wire frame is first threaded into the channel 31 during manufacture of the tent or when it is required to remove the frame possibly for long-term storage or transportation of the tent, or to enable a frame to be replaced in the event of breaking or buckling during use, for example.

In some embodiments of the invention, the wall members may be rectangularly shaped, including square shaped, with their side members joined and separated by a strip of material as described. In these cases, the corners of the wall members are suitably arcuate such that the wire frame is not buckled or over-strained at the corners when the wall members are in their expanded configuration.

I claim:

1. A foldable tent, having a top, which can be transformed from a fully collapsed configuration to a self supporting expanded configuration and vice versa, the tent comprising three or more joined together wall members, each wall member having a flexible frame formed of a single loop of coilable material when expanded and overlapping loops when collapsed and a wall panel of foldable material having a peripheral channel for constraining the frame into a generally triangular or rectangular shape with two sides and a base for each wall member with the sides extending from the top of the tent to said base when the wall panel is expanded, in which the sides of each wall member are securely and hingably joined to the adjacent sides of adjacent wall members from said top to said base so that the adjacent sides are held at least generally parallel to one another when the tent is in its expanded configuration.

2. A tent according to claim 1 in which the adjacent sides are each joined together and separated from one another by a respective elongate strip of foldable material extending along and between the sides of the wall members.

3. A tent according to claim 1 including a tent floor formed of foldable material which extends between and joins together the bases of the wall members.

4. A tent according to claim 1, including a foldable roof panel which extends between and connects the apexes of the triangles together or the tops of the rectangles.

5. A tent according to claim 1, including ground ties fixed to the tent generally in alignment with central axes parallel to each pair of adjacent sides of wall members.

6. A tent according to claim 1, in which each wall is a well-rounded triangular or rectangular shape when expanded.

7. A tent according to claim 1, in which one or more of the panels is provided with a closable opening to form a respective door of the tent.

8. A tent according to claim 1, in which at least one of the panels is formed of transparent or translucent material.

9. A tent according to any one of claims 1, 4, 5 and 6 wherein said sides of each wall member are joined to adjacent sides of adjacent wall members inwardly of said peripheral channel with the peripheral channel and associated frame for each wall member being free of the channel and associated frame of each other wall member.

10. A foldable tent, having a top, which can be transformed from a fully collapsed configuration to a self supporting expanded configuration and vice versa, the tent comprising three or more joined together wall members, each wall member having a flexible frame formed of a single loop of coilable material when expanded and overlapping loops when collapsed; and a wall panel of foldable material having a peripheral channel for constraining the frame into a generally triangular shape defining two sides, a base and an apex for each wall member with the sides extending between said apex and said base and said apex being located at the top of the tent when the wall panel is expanded; said sides of each wall member being securely and hingably joined to adjacent sides of adjacent wall members from said apex to said base so that the adjacent sides are held at least generally parallel to one another when the tent is in its expanded configuration.

11. A foldable tent, having a top, which can be transformed from a fully collapsed configuration and vice versa, the tent comprising three or more joined together wall members, each wall member having a flexible frame formed of a single loop of coilable material when expanded and overlapping loops when collapsed; and a wall panel of foldable material having a peripheral channel enclosing said frame and constraining the frame into one shape from the group consisting of triangular and rectangular shapes defining two sides and a base for each wall member with the sides extending from the top of the tent to said base when the wall panel is expanded; said sides of each wall member being securely and hingably joined to adjacent sides of adjacent wall members inwardly of said peripheral channel with the adjacent sides held at least generally parallel to and spaced from one another when the tent is in its expanded configuration.

12. A tent according to claim 11 wherein the adjacent sides of adjacent wall members are joined together and spaced from one another by an elongate strip of foldable material extending along and between said adjacent sides.

13. A tent according to claim 12 wherein said elongated strips between adjacent sides of adjacent wall members are connected together at the top of the tent to define a foldable roof panel.

14. A tent according to claim 11 or claim 12 wherein said adjacent sides are joined together from the top of said tent to said base of each wall member.

* * * * *